US009171511B2

(12) United States Patent
Park et al.

(10) Patent No.: US 9,171,511 B2
(45) Date of Patent: Oct. 27, 2015

(54) LIQUID CRYSTAL DISPLAY

(71) Applicant: Samsung Display Co., Ltd., Yongin, Gyeonggi-Do (KR)

(72) Inventors: SukJin Park, Daejeon (KR); Dongwon Park, Asan-si (KR); Jae-Gwan Jeon, Incheon (KR); Akihiro Takegama, Hwaseong-si (KR); Jaehyoung Park, Suwon-si (KR); Junpyo Lee, Asan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 242 days.

(21) Appl. No.: 13/736,622

(22) Filed: Jan. 8, 2013

(65) Prior Publication Data

US 2013/0321253 A1 Dec. 5, 2013

(30) Foreign Application Priority Data

May 31, 2012 (KR) ..... 10-2012-0058610

(51) Int. Cl.
*G09G 3/36* (2006.01)

(52) U.S. Cl.
CPC ..... *G09G 3/3611* (2013.01); *G09G 3/3614* (2013.01); *G09G 2320/0261* (2013.01); *G09G 2360/16* (2013.01)

(58) Field of Classification Search
CPC ..... G09G 2340/16; G09G 2320/0223; G09G 2320/0261; G09G 2310/021
See application file for complete search history.

(56) References Cited

U.S. PATENT DOCUMENTS

| | | | | |
|---|---|---|---|---|
| 6,549,187 | B1 | 4/2003 | Matsubara et al. | |
| 6,842,161 | B2 | 1/2005 | Song et al. | |
| 6,891,522 | B2 | 5/2005 | Song et al. | |
| 7,327,344 | B2 | 2/2008 | Asada et al. | |
| 2001/0022570 | A1 * | 9/2001 | Chang et al. | 345/98 |
| 2002/0024481 | A1 * | 2/2002 | Kawabe et al. | 345/87 |
| 2003/0058375 | A1 * | 3/2003 | Moon et al. | 349/42 |
| 2003/0098833 | A1 * | 5/2003 | Sekido et al. | 345/87 |
| 2003/0160753 | A1 * | 8/2003 | McCartney | 345/99 |
| 2006/0007081 | A1 * | 1/2006 | Chien et al. | 345/87 |
| 2006/0279506 | A1 * | 12/2006 | Choi | 345/98 |
| 2007/0200811 | A1 * | 8/2007 | So | 345/89 |
| 2009/0085927 | A1 * | 4/2009 | Jung | 345/606 |
| 2010/0238151 | A1 | 9/2010 | Kitayama et al. | |
| 2011/0012887 | A1 | 1/2011 | Lee et al. | |
| 2012/0139895 | A1 * | 6/2012 | Kim | 345/213 |

FOREIGN PATENT DOCUMENTS

| | | |
|---|---|---|
| KR | 10-20020052071 | 7/2002 |
| KR | 10-2003-0055892 | 7/2003 |
| KR | 10-2004-0048523 | 6/2004 |

(Continued)

*Primary Examiner* — Sanjiv D Patel
(74) *Attorney, Agent, or Firm* — Innovation Counsel LLP

(57) ABSTRACT

A liquid crystal display includes a display panel, a timing controller, a gate driver, and a data driver. The display panel includes a plurality of pixels. The timing controller receives an image data, compares a previous line data with a present line data to determine whether the present line data needs to be compensated, and generates a first modulation line data. In addition, the timing controller calculates the first modulation data and a delay compensation value to generate a second modulation line data. The delay compensation value is decided from reference delay compensation values of reference pixels among the pixels.

20 Claims, 4 Drawing Sheets

(56) References Cited

FOREIGN PATENT DOCUMENTS

| | | |
|---|---|---|
| KR | 10-2005-0068605 | 7/2005 |
| KR | 10-2009-0044469 | 5/2009 |
| KR | 10-2009-0086867 | 8/2009 |
| KR | 10-2011-0064494 | 6/2011 |
| KR | 10-2011-0072574 | 6/2011 |
| KR | 10-2011-0024993 | 9/2011 |

* cited by examiner

LIQUID CRYSTAL DISPLAY

CROSS-REFERENCE TO RELATED APPLICATION

This U.S. non-provisional patent application claims priority under 35 U.S.C. §119 of Korean Patent Application No. 10-2012-0058610, filed on May 31, 2012, the contents of which are hereby incorporated by reference.

BACKGROUND

1. Field of Disclosure

Embodiments of the invention generally relate to a liquid crystal display. More particularly, the present disclosure relates to a liquid crystal display capable of improving a display quality of a moving image.

2. Description of the Related Art

In general, a liquid crystal display includes two substrates and a liquid crystal layer disposed between the two substrates. The liquid crystal display applies an electric field to the liquid crystal layer and controls intensity of the electric field to control transmittance of light passing through the liquid crystal layer, thereby displaying desired images.

The liquid crystal display inverts a polarity of a data voltage, which corresponds to each pixel, in the unit of frame, row, column, or dot with reference to a common voltage in order to prevent liquid crystals from being deteriorated due to the electric field that is applied to the liquid crystals in the same direction.

In the liquid crystal display, recently, an inversion scheme that inverts the polarity of the data voltage at every dot in the row direction and at every two dots in the column direction is widely used. However, due to a gray scale difference between data voltages, which have the same polarity and are adjacent to each other, a horizontal line is perceived between adjacent pixels to which the data voltages area applied.

In addition, according to a position of a gate driver and a data driver in the liquid crystal display, a gate signal delay occurs in each pixel according to the distance from the gate driver and each pixel, and a data signal delay occurs in each pixel according to the distance from the data driver and each pixel. The gate signal delay and the data signal delay produce defects of charging characteristic of the data voltage applied to each pixel. The defects of charging characteristic are affected by a position of a light source too.

SUMMARY

The present disclosure provides a liquid crystal display capable of compensating brightness difference between adjacent pixels applied with the same polarity of data voltage to improve an image display quality.

The present disclosure provides a liquid crystal display capable of displaying an image at proper gray scale level regardless of a position of a gate driver, a data driver, and a light source.

Embodiments of the inventive concept provide a liquid crystal display includes a display panel, a timing controller, a gate driver, and a data driver.

The display panel may include a plurality of pixels, a plurality of gate lines electrically connected to the pixels, and a plurality of data lines electrically connected to the pixels to display an image.

The timing controller may receive an image data, compare a previous line data and a present line data to determine whether the present line data needs to be compensated to generate a first modulation line data. In addition, the timing controller may calculate the first modulation line data and a delay compensation value to generate a second modulation line data. The delay compensation value may be decided from reference delay compensation values of reference pixels among the pixels.

The gate driver may drive the gate lines. The data driver may receive the second modulation line data and apply a data voltage corresponding to the second modulation line data to the data lines.

The data driver may invert a polarity of the data voltage at every column and at every two rows.

The data voltage of the previous line data may have a same polarity as the data voltage corresponding to the present line data.

The timing controller may include a first modulator that generates the first modulation line data having the compensated present line data and a second modulator that generates the second modulation line data having data compensated using a delay compensation value.

The first modulator may include a memory, a gray-scale difference calculator, a judging part, and a look-up table. The first modulator may compensate for the present line data and outputs the compensated present line data.

The memory may store the present line data and outputs the previous line data.

The gray-scale difference calculator may be connected to the memory and calculate the gray-scale difference between the previous line data and the present line data.

The judging part may be connected to the gray scale difference calculator, and judge whether the present line data needs to be compensated based on the gray-scale difference and compensate for the present line data.

The look-up table may be connected to the judging part and store a data compensation value corresponding to the gray-scale difference.

The second modulator may include a delay compensator and an operator.

The delay compensator may be connected to the judging part and generate the delay compensation value of each of the pixels.

The operator may be connected to the judging part and the delay compensator, and generate the second modulation line data using the first modulation line data and the delay compensation value.

The delay compensator may include a panel gray-scale identifier, a reference pixel selector, and a calculator.

The panel gray-scale identifier may determine the reference delay compensation values of the reference pixels.

The reference pixel selector may be connected to the panel gray-scale identifier and select the reference pixels surrounding a delay pixel which is to be compensated among the pixels.

The calculator may be connected to the reference pixel selector and calculate the delay compensation value of the delay pixel using the reference delay compensation values of the selected reference pixels.

The number of the reference pixels may be at least four.

The number of the reference pixels may be nine.

The gray scale of the compensated present line data may be smaller than a gray scale of the present line data.

According to the above, the liquid crystal display compensates for the brightness difference between pixel rows adjacent to each other, which are applied with the data voltages having the same polarity, thereby improving a display quality thereof.

In addition, the liquid crystal display may display the image at proper gray scale level regardless of the position of the gate driver, the data driver, and the light source.

BRIEF DESCRIPTION OF THE DRAWINGS

The above and other advantages of the present invention will become readily apparent by reference to the following detailed description when considered in conjunction with the accompanying drawings wherein.

DETAILED DESCRIPTION

Figure 1:
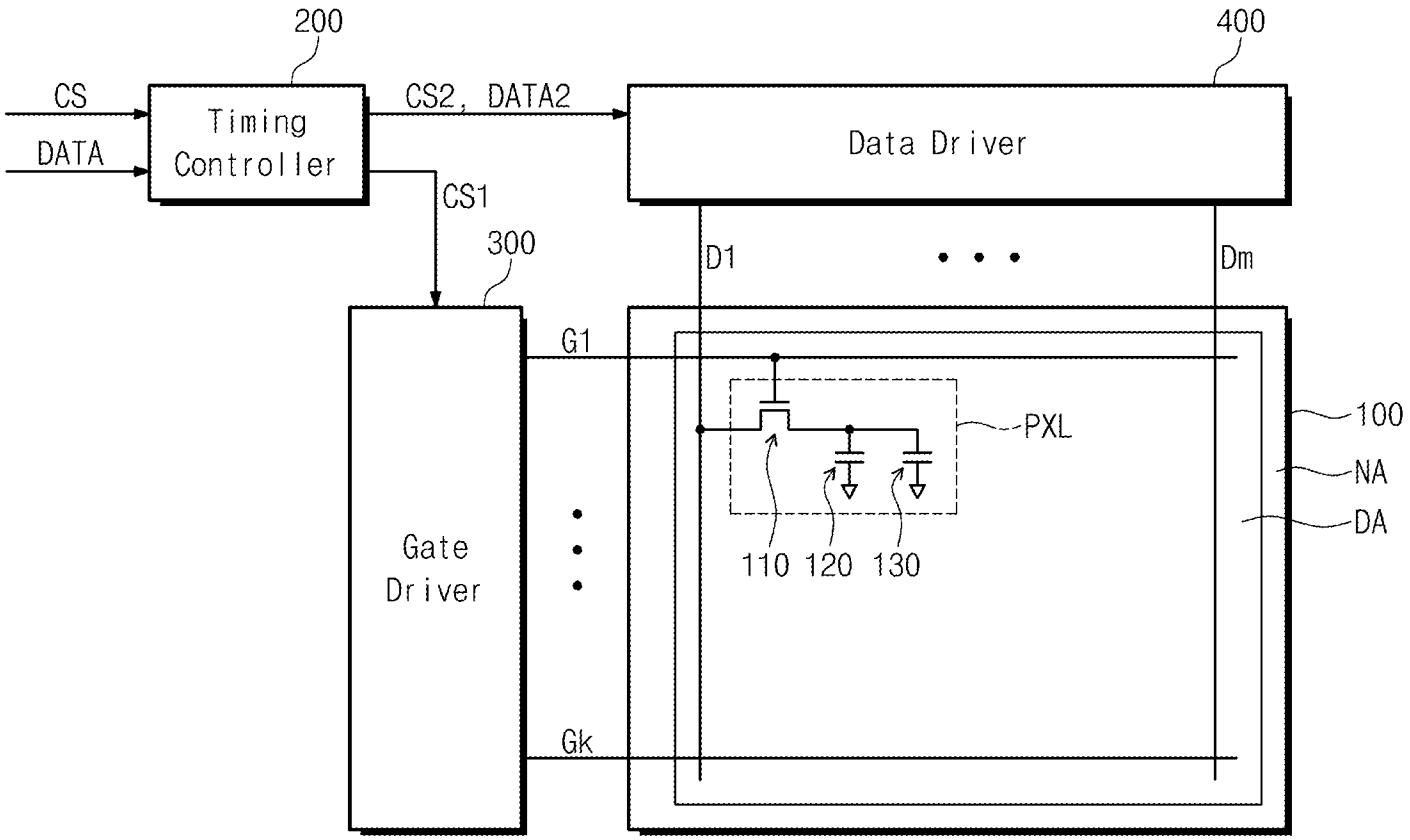
FIG. 1 is a block diagram showing a liquid crystal display according to an exemplary embodiment of the present invention.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

FIG. 1 is a block diagram showing a liquid crystal display according to an exemplary embodiment of the present invention.

Referring to FIG. 1, the liquid crystal display includes a display panel 100, a timing controller 200, a gate driver 300, and a data driver 400.

The display panel 100 includes a plurality of gate lines G1 to Gk receiving a gate signal and a plurality of data lines D1 to Dm receiving a data voltage. The gate lines G1 to Gk are insulated from the data lines D1 to Dm while crossing the data lines D1 to Dm. The display panel 100 includes a display area DA where an image is displayed and a non-display area NA adjacent to the display area DA to surround the display area DA. The display area DA of the display panel 100 includes a plurality of pixel areas arranged in a matrix configuration, and a plurality of pixels is arranged in the pixel areas, respectively. Accordingly, the display panel 100 may include at least k pixel rows defined by the gate lines G1 to Gk. In FIG. 1, an equivalent circuit of one pixel PXL among the pixels has been shown as a representative example. The pixel PXL includes a thin film transistor 110, a liquid crystal capacitor 120, and a storage capacitor 130.

Although not shown in figures, the thin film transistor 110 includes a gate electrode, a source electrode, and a drain electrode. The gate electrode is connected to a first gate line G1 among the gate lines G1 to Gk. The source electrode is connected to a first data line D1 among the data lines D1 to Dm. The drain electrode is connected to the liquid crystal capacitor 120 and the storage capacitor 130. The liquid crystal capacitor 120 and the storage capacitor 130 are connected to the drain electrode in parallel.

In addition, the display panel 100 may include a first display substrate, a second display substrate facing the first display substrate, and a liquid crystal layer interposed between the first display substrate and the second display substrate.

The gate lines G1 to Gk, the data lines D1 to Dm, the thin film transistor 110, and a pixel electrode (not shown), which serves as a first electrode of the liquid crystal capacitor 120, are disposed on the first display substrate. The thin film transistor 110 applies the data voltage to the pixel electrode in response to the gate signal.

A common electrode (not shown), which serves as a second electrode of the liquid crystal capacitor 120, is disposed on the second display substrate, and a reference voltage is applied to the common electrode. The liquid crystal layer serves as a dielectric substance between the pixel electrode and the common electrode. The liquid crystal capacitor 120 is charged with a voltage corresponding to an electric potential difference between the data voltage and the reference voltage.

Although not shown in figures, the display panel 100 may further include a backlight unit (not shown) disposed thereunder. The backlight unit may provide a light to the display panel 100. The backlight unit may include at least one light source (not shown). The light source is provided in singular at a side of the display panel 100 in a plan view, or the light source provided in plural at both sides of the display panel 100 in a plan view. The light source may be, but not limited to, a light emitting diode (LED) or a cold cathode fluorescent lamp (CCFL).

The timing controller 200 receives a control signal CS to generate a gate control signal CS1 and a data control signal CS2. The timing controller 200 applies the gate control signal CS1 to the gate driver 300 and applies the data control signal CS2 to the data driver 400.

The gate control signal CS1 includes a vertical start signal that starts an operation of the gate driver 300 and a gate clock signal that determines an output timing of the gate signal.

The data control signal CS2 includes a horizontal start signal that starts an operation of the data driver 400, a polarity inversion signal that controls a polarity of a data voltage, and a load signal that determines an output timing of the data voltage from the data driver 400.

The timing controller 200 receives an image data DATA from an external source (not shown) and modulates the image data DATA to generate a second modulation line data DATA2.

The configuration and arrangement of the timing controller will be described in detail later.

The gate driver 300 is electrically connected to the gate lines G1 to Gk arranged in the display panel 100 to apply the gate signal to the gate lines G1 to Gk. In detail, the gate driver 300 generates the gate signal to drive the gate lines G1 to Gk according to the gate control signal CS1 from the timing controller 200 and sequentially outputs the generated gate signal to the gate lines G1 to Gk.

The data driver 400 is electrically connected to the data lines D1 to Dm to apply the data voltage to the data lines D1 to Dm. The data driver 400 converts the second modulation line data DATA2, which is a digital signal, to the data voltage, which is an analogue signal, based on a gamma voltage (not shown) from a gamma voltage generator (not shown). The data driver 400 utilizes a negative-polarity gamma voltage or a positive-polarity gamma voltage in response to the polarity inversion signal so as to determine the polarity of the data voltage.

Figure 2:
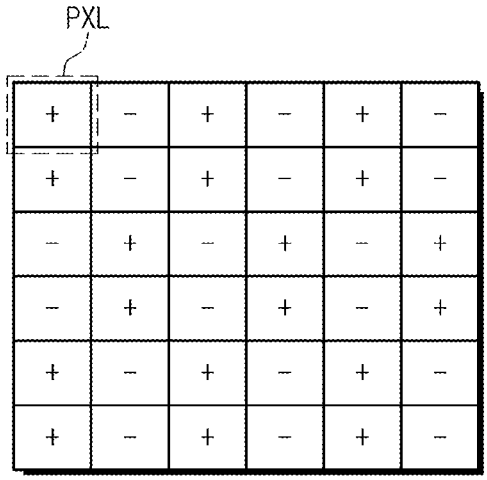
FIG. 2 is a display panel showing a polarity of a data voltage applied to each pixel.

FIG. 2 is a display panel showing the polarity of the data voltage applied to each pixel. FIG. 2 shows thirty-six pixels arranged in a matrix configuration of six rows by six columns.

Referring to FIG. 2, the data driver 400 inverts the polarity of the data voltage of the pixels PXL at every column and at every two rows.

Figure 3:
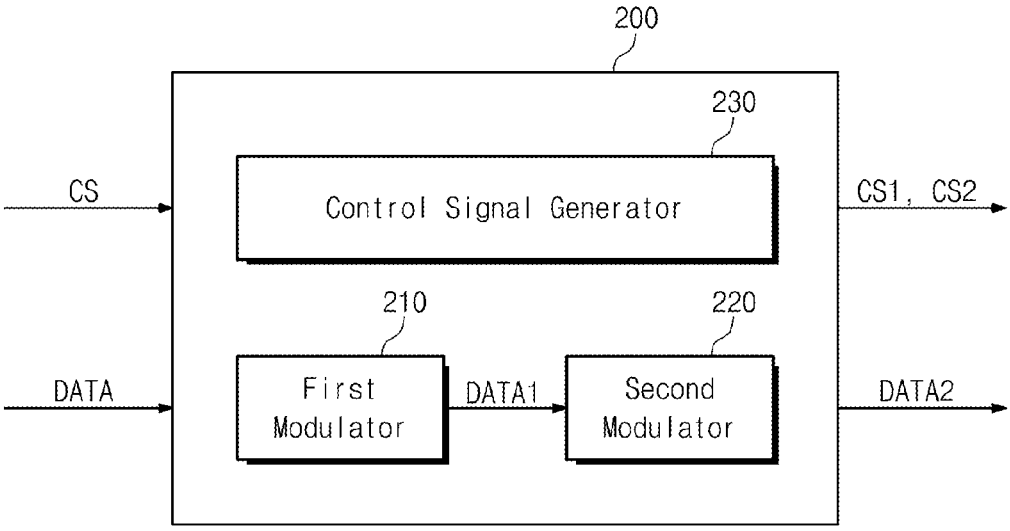
FIG. 3 is a block diagram showing a timing controller shown in FIG. 1.

FIG. 3 is a block diagram showing the timing controller of FIG. 1.

Referring to FIG. 3, the timing controller 200 includes a first modulator 210, a second modulator 220, and a control signal generator 230.

The first modulator 210 may receive the image data DATA for one row at a time. The first modulator 210 compares a previous line data with a present line data and determines whether or not the present line data needs to be compensated to generate a first modulation line data DATA1.

The second modulator 220 comprises an operator and a delay compensator. The second modulator 220 receives the first modulation line data DATA1 from the first modulator 210 and generates a delay compensation value using delay compensator 221. The operator 222 receives the first modulation line data DATA1 from the first modulator 210 and the delay compensation value from the delay compensator 221 and generates the second modulation line data DATA2.

The timing controller 200 outputs the second modulation line data DATA2 to the data driver 400 for one frame at a time.

The control signal generator 230 receives the control signal CS to generate the gate control signal CS1 and the data control signal CS2. The control signal CS may include a data enable signal, a dot clock signal, a vertical synchronization signal, a horizontal synchronization signal, etc.

Figure 4:
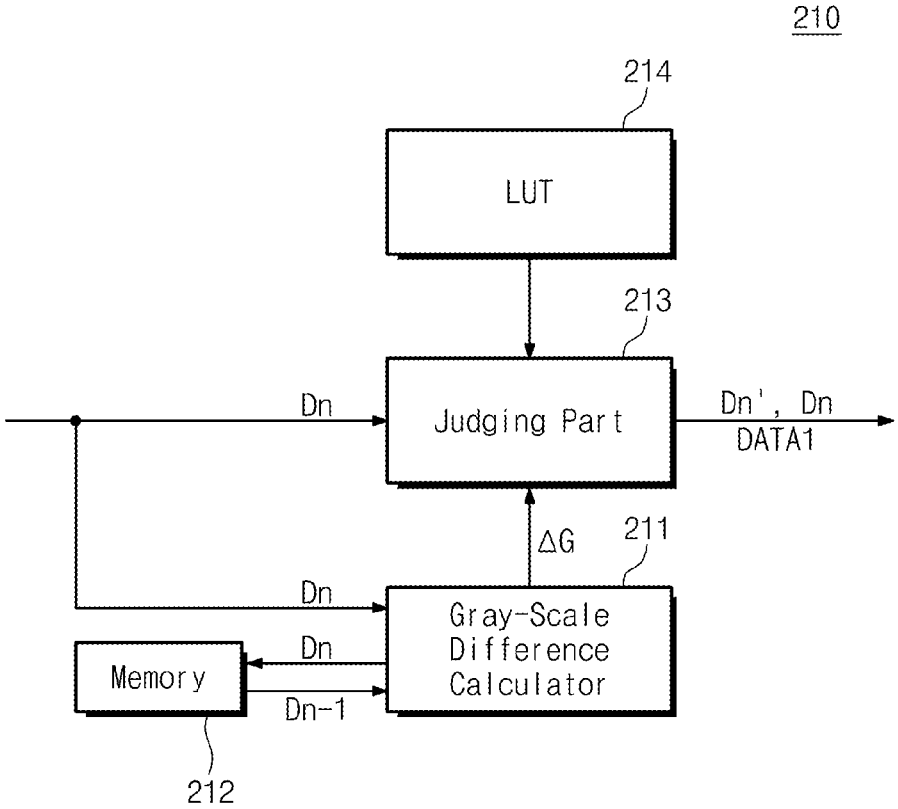
FIG. 4 is a block diagram showing a first modulator shown in FIG. 3.

FIG. 4 is a block diagram showing the first modulator of FIG. 1 shown in FIG. 3.

Referring to FIG. 4, the first modulator 210 includes a gray-scale difference calculator 211, a memory 212, a judging part 213, and a look-up table 214.

The gray-scale difference calculator 211 receives the image data DATA for one row at a time from the system such as graphic controller (not shown). The data for one row may be a data provided to one row of pixels in the matrix of pixels. Hereinafter, the data for one row provided to an n-th pixel row among first to k pixel rows is referred to as a present line data Dn, and the data for one row provided to an (n−1)th pixel row is referred to as a previous line data Dn−1. The data voltage corresponding to the present line data Dn may have the same polarity as a polarity of the data voltage corresponding to the previous line data Dn−1. The gray-scale difference calculator 211 receives the present line data Dn. Also, the gray-scale difference calculator 211 outputs the present line data Dn to the memory 212 and reads out the previous line data Dn−1 from the memory 212. The gray-scale difference calculator 211 calculates a gray-scale difference ΔG between the present line data Dn and the previous line data Dn−1.

The memory 212 stores the present line data Dn provided from the gray-scale difference calculator 211. After a time period, which is required to apply the gate signal to one row, lapses, the present line data Dn may become the previous line data Dn−1. In this case, the memory 212 outputs the previous line data Dn−1 to the gray-scale difference calculator 211 and stores a new present line data newly provided from the gray-scale difference calculator 211. The present line data Dn may be directly provided from the display system such as the graphic controller (not shown) to the memory 212. The memory 212 may be, but not limited to, a line memory.

The judging part 213 receives the gray-scale difference ΔG from the gray-scale difference calculator 211 and the present line data Dn from the display system and judges whether or not compensation is necessary. When the gray-scale difference ΔG is equal to or larger than a predetermined reference value, the judging part 213 compensates for the present line data Dn to output the compensated present line data Dn'. When the gray-scale difference ΔG is smaller than the predetermined reference value, the judging part 213 outputs the present line data Dn without compensation for the present line data Dn.

Thus, the first modulation line data DATA1 may be the compensated present line data Dn' or the present line data Dn.

When the gray-scale difference ΔG is equal to or larger than the reference value, the judging part 213 selects a compensated present line data Dn' from the look-up table 214. A gray-scale difference between the compensated present line data Dn' and the previous line data Dn−1 may be smaller than a gray-scale difference between the present line data Dn and the previous line data Dn−1.

In the present exemplary embodiment, compensated present lin datas are stored in the look-up table 214 according to the gray-scale difference ΔG and a gray-scale of the present line data Dn.

In the liquid crystal display according to the present exemplary embodiment, as described with reference to FIG. 2, the data driver 400 inverts the polarity of the data voltage of each pixel PXL at every column and at every two rows, but it should not be limited thereto or thereby. That is, according to embodiments, the data driver 400 may invert the polarity of the data voltage at every column and at every three rows. In this case, the first modulator 210 may determine whether or not three data lines, which are arranged adjacent to each other and have the data voltage with the same polarity, need to be compensated and generate the first modulation line data DATA1.

In the display apparatus according to the present exemplary embodiment, the first modulator 210 generates the first modulation line data DATA1, and thus brightness difference between pixel rows adjacent to each other, to which the data voltage having the same polarity is applied, may be compensated. Therefore, a horizontal line may be prevented from being perceived between adjacent pixel rows applied with the data voltage having the same polarity.

Figure 5:
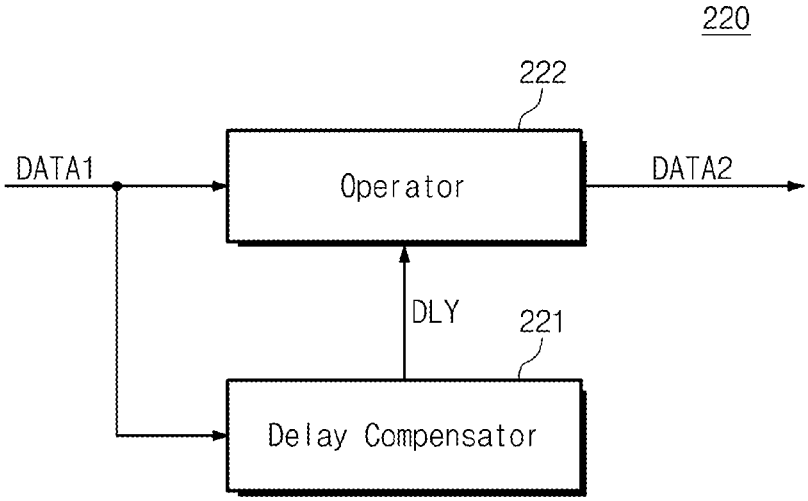
FIG. 5 is a block diagram showing a second modulator shown in FIG. 3.

FIG. 5 is a block diagram showing the second modulator 220 of FIG. 3.

Referring to FIG. 5, the second modulator 220 includes a delay compensator 221 and an operator 222.

The delay compensator 221 calculates the delay compensation value DLY of each pixel PXL.

The delay compensation value DLY indicates degree for delay compensation of the gate signal and the data signal, which are applied to each pixel in comparison with a reference pixel. Due to the delay compensation value DLY, a defect in charging characteristic of the data voltage in each pixel is prevented. Thus defect occurring in gray-sale of the data voltage, which is caused by the defect in charging characteristic in each pixel, is prevented.

The delay compensation value DLY may be influenced by the position of the gate driver 300 and the data driver 400, which are arranged on the display panel 100.

Referring again to FIG. 1, when the gate driver 300 is disposed on a left region of the display panel 100 and the data driver 400 is disposed on an upper region of the display panel 100. The gate signal delay in a pixel increases according to the distance from the gate driver to the pixel. That is, a pixel on the right side of the display panel 100 has a gate signal delay bigger than that of a pixel on the left side of the display panel. The data signal delay in a pixel increases according to the distance from the data driver to the pixel. That is, a pixel on the bottom side of the display panel 100 has a data signal delay bigger than that of a pixel on the upper side of the display panel.

For instance, both of the gate signal delay and the data signal delay do not occur in a pixel PXL connected to the first gate line G1 and the first data line D1. The gate signal delay does not occur in the pixel PXL connected to the first data line D1, but the pixels connected to the data line Dm have a significant data signal delay. The data signal delay does not occur in the pixel PXL connected to the first gate line G1, but the pixels connected to the gate line Gk have significant data signal delay. Both of the significant gate signal delay and the significant data signal delay occur in the pixel PXL connected to the m-th data line Dm and the k-th gate line Gk.

The delay compensation value DLY may also be influenced by the position of the light source (not shown). A temperature in each pixel in the display panel 100 may differ according to the position of the light source. When the temperature is different in each pixel, a resistance of wires, e.g., the gate lines G1 to Gk and the data lines D1 to Dm, and an on-current of the thin film transistor become different in each pixel, and thus the defect in charging characteristic occurs.

In case that the light source is located at one portion of the upper portion, the lower portion, the left portion, and the right portion of the display panel 100, the temperature in the one portion at which the light source is located may be higher than the other portions. The difference in temperature between the one portion and the other portions is caused by a heat emitted by the light source.

When two light sources are located at both sides of the display panel 100, the temperature on both sides of the display panel 100 may be higher than the temperature on a center of the panel.

Referring again to FIG. 5, the operator 222 receives the first modulation line data DATA1 and the delay compensation value DLY. The operator 222 receives the delay compensation value DLY of one row at a time corresponding to the first modulation line data DATA1 and generates the second modulation line data DATA2 according to the first modulation data DATA1 and the delay compensation value DLY.

Figure 6:
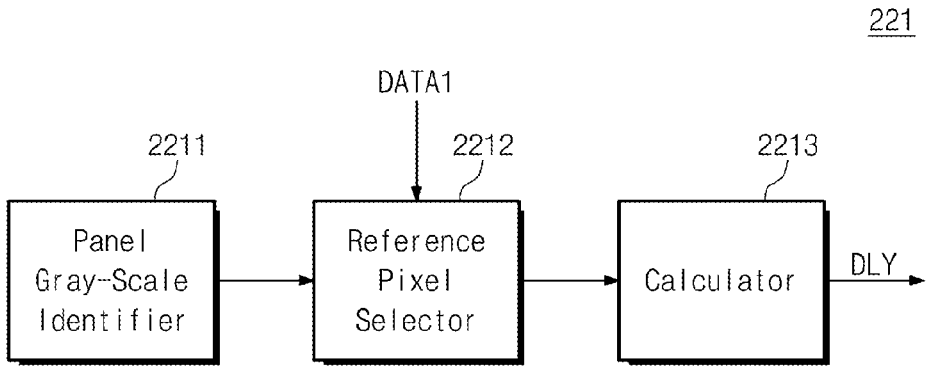
FIG. 6 is a block diagram showing a delay compensator shown in FIG. 5.
Figure 7:
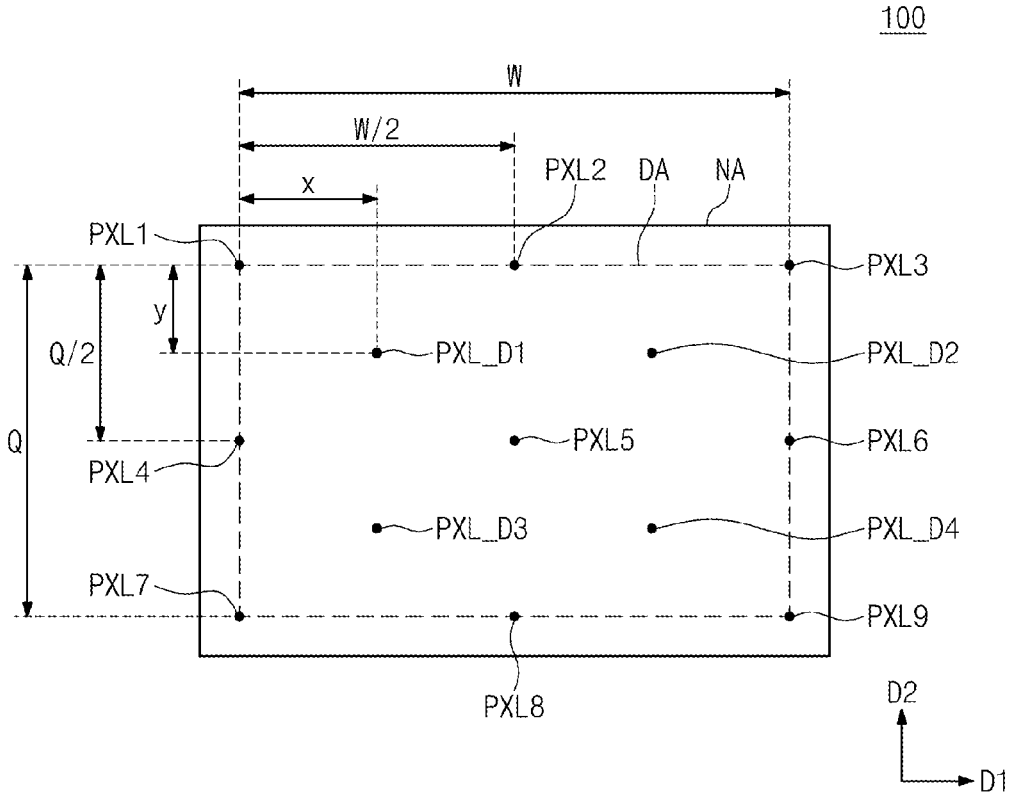
FIG. 7 is a display panel showing reference pixels.

FIG. 6 is a block diagram showing the delay compensator 221 shown in FIG. 5, and FIG. 7 is a display panel 100 showing reference pixels.

Referring to FIG. 6, the delay compensator 221 includes a panel gray-scale identifier 2211, a reference pixel selector 2212, and a calculator 213.

The panel gray-scale identifier 2211 applies the data voltage having uniform gray-scale to the pixels in the display panel 100 to identify the gray-scale of the image displayed in the pixels. The panel gray-scale identifier 2211 may identify the gray-scale of the image displayed in the reference pixels among the pixels.

Referring to FIG. 7, nine reference pixels, e.g., first to ninth reference pixels PXL1 to PXL9, are arranged in the display area DA of the display panel 100. The first to ninth reference pixels PXL1 to PXL9 may be arranged in four corners of the display area DA, center portions of four sides of the display area DA, and a center portion of the display area DA, respectively. The first to ninth reference pixels PXL1 to PXL9 may display images with different gray-scales from each other according to the position of the gate driver 300, the data driver 400, and the light source (not shown) even though the data voltage having the same gray-scale is applied to the first to ninth reference pixels PXL1 to PXL9.

The panel gray-scale identifier 2211 determines first to ninth reference delay compensation values of the first to ninth reference pixels PXL1 to PXL9. The first to ninth reference delay compensation values may be entered by a user or may be entered by a manufacturer.

Referring again to FIG. 6, the reference pixel selector 2212 selects the reference pixels surrounding a delay pixel. The delay pixel is a pixel, which is to be delay-compensated among pixel rows corresponding to the first modulation line data DATA1. In FIG. 7, the delay pixel is one of a first delay pixel PXL_D1, a second delay pixel PXL_D2, a third delay pixel PXL_D3, and a fourth delay pixel PXL_D4.

In a case that the delay pixel is the first delay pixel PXL_D1, the first delay pixel PXL_D1 is surrounded by the first reference pixel PXL1, the second reference pixel PXL2, the fourth reference pixel PXL4, and the fifth reference pixel PXL5, and thus the reference pixel selector 2212 selects the first, second, fourth, and fifth reference pixels PXL1, PXL2, PXL4, and PXL5. In a case that the delay pixel is the second delay pixel PXL_D2, the second delay pixel PXL_D2 is surrounded by the second reference pixel PXL2, the third reference pixel PXL3, the fifth reference pixel PXL5, and the sixth reference pixel PXL6, and thus the reference pixel selector 2212 selects the second, third, fifth, and sixth reference pixels PXL2, PXL3, PXL5, and PXL6. Similarly, in a case that the delay pixel is the third delay pixel PXL_D3, the reference pixel selector 2212 selects the fourth, fifth, seventh, and eighth reference pixels PXL4, PXL5, PXL7, and PXL8, and in a case that the delay pixel is the fourth delay pixel PXL_D4, the reference pixel selector 2212 selects the fifth, sixth, eighth, and ninth reference pixels PXL5, PXL6, PXL8, and PXL9.

The calculator 2213 calculates the delay compensation value DLY of the delay pixel using the reference delay compensation values of the reference pixels selected by the reference pixel selector 2212.

The delay compensation value DLY may be calculated by a linear interpolation using the reference delay compensation value. In case of the first delay pixel PXL_D1, the first reference pixel PXL1, the second reference pixel PXL2, the fourth reference pixel PXL4, and the fifth reference pixel PXL5 are selected as the reference pixels.

When the reference delay compensation values of the first, second, fourth, and fifth reference pixels PXL1, PXL2, PXL4, and PXL5 are referred to as a first delay compensation value E1, a second delay compensation value E2, a fourth delay compensation value E4, and a fifth delay compensation value E5, respectively, the delay compensation value DLY of the first delay pixel PXL_D1 may be obtained by the following Equation.

$$DLY = [(E5 - E4) - (E2 - E1)] \times \frac{4x \times y}{Q \times W} + (E4 - E1) \times \frac{2y}{W} + (E2 - E1) \times \frac{2x}{Q} + E1 \quad \text{Equation}$$

In Equation, W denotes a length of the display area DA of the display panel 100 in a first direction D1, Q denotes a length of the display area DA of the display panel 100 in a second direction D2, x denotes a distance between the first delay pixel PXL_D1 and the first reference pixel PXL1 in the first direction, and y denotes a distance between the first delay pixel PXL_D1 and the first reference pixel PXL1 in the second direction D2.

In the above, a process of calculating the delay compensation value DLY of the first delay pixel PXL_D1 has been described, but the delay compensation values DLY of the pixels that include the second to fourth delay pixels PXL_D2 to PXL_D4 may be calculated using the similar process.

According to the exemplary embodiment shown in FIG. 7, nine reference pixels, e.g., the first to ninth reference pixels PXL1 to PXL9, arranged in the display area DA of the display panel 100 have been described. However, the number of the reference pixels should not be limited thereto or thereby if the number of the reference pixels is equal to or larger than four. For example, four reference pixels may be respectively arranged at corners of the display area DA in the display panel 100. Meanwhile, in addition to the first to ninth reference pixels PXL1 to PXL9, sixteen reference pixels may be further arranged at center portions of lines that connect the first to ninth reference pixels PXL1 to PXL9, so that a total of twenty five reference pixels may be arranged in the display area DA of the display panel 100.

In the liquid crystal display according to the exemplary embodiment, the delay compensation value of each pixel may be compensated by the second modulator 220. Therefore, the liquid crystal display may display the image at the desired gray-scale level regardless of the position of the gate driver 300, the data driver 400, and the light source in the display panel 100.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A liquid crystal display comprising:

a display panel that includes a plurality of pixels, a plurality of gate lines electrically connected to the pixels, and a plurality of data lines electrically connected to the pixels to display an image;

a gate driver that drives the gate lines;

a timing controller that receives an image data, compares a previous line data and a present line data to determine whether the present line data needs to be compensated to generate a first modulation line data, and calculates the first modulation line data and a delay compensation value to generate a second modulation line data; and a data driver that receives the second modulation line data and applies a data voltage corresponding to the second modulation line data to the data lines, wherein the delay compensation value is decided from reference delay compensation values of reference pixels among the pixels; and wherein the present line data is compensated to decrease difference between the present line data and the previous line data.

2. The liquid crystal display of claim 1, wherein the data driver inverts a polarity of the data voltage at every column and at every two rows.

3. The liquid crystal display of claim 2, wherein the data voltage of the previous line data has a same polarity as the data voltage of the present line data.

4. The liquid crystal display of claim 1, wherein the timing controller comprises:

a first modulator that generates the first modulation line data having the compensated present line data; and a second modulator that generates the second modulation line data having data compensated using a delay compensation value.

5. The liquid crystal display of claim 4, wherein the first modulator compensates for the present line data and outputs the compensated present line data.

6. The liquid crystal display of claim 5, wherein the first modulator comprises:

a memory storing the present line data and outputting the previous line data;

a gray-scale difference calculator connected to the memory and calculating the gray-scale difference between the present line data and the previous line data;

a judging part connected to the gray scale difference calculator, and judging whether the present line data needs to be compensated based on the gray-scale difference and compensating for the present line data; and a look-up table connected to the judging part and storing a data compensation value corresponding to the gray-scale difference.

7. The liquid crystal display of claim 4, wherein the second modulator comprises:

a delay compensator connected to the judging part and generating the delay compensation value of each of the pixels; and an operator connected to the judging part and the delay compensator, and generating the second modulation line data using the first modulation line data and the delay compensation value.

8. The liquid crystal display of claim 7, wherein the delay compensator comprises:

a panel gray-scale identifier that determines the reference delay compensation values of the reference pixels;

a reference pixel selector connected to the panel gray-scale identifier and selecting the reference pixels surrounding a delay pixel which is to be compensated among the pixels; and a calculator connected to the reference pixel selector and calculating the delay compensation value of the delay pixel using the reference delay compensation values of the selected reference pixels.

9. The liquid crystal display of claim 8, wherein a number of the reference pixels is at least four.

10. The liquid crystal display of claim 9, wherein the number of the reference pixels is nine.

11. The liquid crystal display of claim 4, wherein a gray scale of the compensated present line data is smaller than a gray scale of the present line data.

12. The liquid crystal display of claim 11, further comprising a data driver that inverts a polarity of a data voltage at every column and at every two rows.

13. The liquid crystal display of claim 12, wherein the data voltage of the previous line data has same polarity as the data voltage of the present line data.

14. The liquid crystal display of claim 11, wherein the timing controller comprises:

a first modulator that generates a first modulation line data having the compensated present line data; and a second modulator that generates a second modulation line data having data compensated using a delay compensation value.

15. The liquid crystal display of claim 14, wherein the first modulator compensates for the present line data and outputs the compensated present line data.

16. The liquid crystal display of claim 15, wherein the first modulator comprises:

a memory storing the present line data and outputting the previous line data;

a gray-scale difference calculator connected to the memory and calculating the gray-scale difference between the present line data and the previous line data;

a judging part connected to the gray scale difference calculator, and judging whether the present line data needs to be compensated based on the gray-scale difference and compensating for the present line data; and a look-up table connected to the judging part and storing a data compensation value corresponding to the gray-scale difference.

17. The liquid crystal display of claim 14, wherein the second modulator comprises:

a delay compensator connected to the judging part and generating the delay compensation value of each of the pixels; and an operator connected to the judging part and the delay compensator, and generating the second modulation line data using the first modulation line data and the delay compensation value.

18. The liquid crystal display of claim 17, wherein the delay compensator comprises:

a panel gray-scale identifier that determines a reference delay compensation values of a reference pixels;

a reference pixel selector connected to the panel gray-scale identifier and selecting the reference pixels surrounding a delay pixel which is to be compensated among the pixels; and a calculator connected to the reference pixel selector and calculating the delay compensation value of the delay pixel using the reference delay compensation values of the selected reference pixels.

19. The liquid crystal display of claim 18, wherein a number of the reference pixels is at least four.

20. The liquid crystal display of claim 19, wherein the number of the reference pixels is nine.

* * * * *